US010253414B2

(12) United States Patent
Clark

(10) Patent No.: US 10,253,414 B2
(45) Date of Patent: Apr. 9, 2019

(54) LIQUID PHASE ATOMIC LAYER DEPOSITION

(71) Applicant: Tokyo Electron Limited, Minato-ku, Tokyo (JP)

(72) Inventor: Robert D. Clark, Livermore, CA (US)

(73) Assignee: Tokyo Electron Limited, Tokyo (JP)

( * ) Notice: Subject to any disclaimer, the term of this patent is extended or adjusted under 35 U.S.C. 154(b) by 87 days.

(21) Appl. No.: 14/871,619

(22) Filed: Sep. 30, 2015

(65) Prior Publication Data

US 2016/0090652 A1 Mar. 31, 2016

Related U.S. Application Data

(60) Provisional application No. 62/057,523, filed on Sep. 30, 2014.

(51) Int. Cl.

| | |
|---|---|
| ***B05D 1/36*** | (2006.01) |
| ***B05D 3/12*** | (2006.01) |
| ***C23C 18/00*** | (2006.01) |
| ***B05D 1/00*** | (2006.01) |
| *B05D 7/00* | (2006.01) |
| *B05D 1/38* | (2006.01) |

(52) U.S. Cl.

CPC ..... *C23C 18/00* (2013.01); *B05D 1/005* (2013.01); *B05D 1/36* (2013.01); *B05D 1/38* (2013.01); *B05D 7/00* (2013.01)

(58) Field of Classification Search

CPC . B05D 1/005; B05D 7/00; B05D 1/36; B05D 1/38; C23C 18/00

USPC ..... 427/240

See application file for complete search history.

(56) References Cited

U.S. PATENT DOCUMENTS

| | | | | |
|---|---|---|---|---|
| 4,701,351 | A * | 10/1987 | Jackson | C23C 18/30 427/305 |
| 5,194,295 | A * | 3/1993 | Iacovangelo | C04B 37/006 205/125 |
| 5,863,603 | A * | 1/1999 | Sandhu | C23C 18/1617 257/E21.174 |
| 2005/0277294 | A1 | 12/2005 | Schaeffer et al. | |
| 2012/0034767 | A1 * | 2/2012 | Xiao | C23C 18/1204 438/493 |
| 2012/0295038 | A1 * | 11/2012 | Ma | C23C 16/18 427/569 |
| 2014/0231968 | A1 * | 8/2014 | Gronheid | G03F 7/091 257/632 |

* cited by examiner

*Primary Examiner* — Kirsten Jolley

(74) *Attorney, Agent, or Firm* — Wood Herron & Evans LLP

(57) ABSTRACT

A processing system and method for depositing a film on a substrate by liquid phase ALD is disclosed in various embodiments. The method includes providing the substrate in a process chamber, spinning on the substrate a first reactant in a first liquid to form a self-limiting layer of the first reactant on the substrate, spinning on the substrate a second reactant in a second liquid, where the second reactant reacts with the self-limiting layer of the first reactant on the substrate to form a film on the substrate, and repeating the spinning steps at least once until the film has a desired thickness. Other embodiments of the invention further include rinsing the substrate to remove excess first and second reactants from the substrate, and heat-treating the substrate during and/or following the film deposition.

20 Claims, 2 Drawing Sheets

LIQUID PHASE ATOMIC LAYER DEPOSITION

CROSS-REFERENCE TO RELATED APPLICATIONS

This application is related to and claims priority to U.S. Provisional Application No. 62/057,523, filed Sep. 30, 2014, the entire contents of which are herein incorporated by reference.

FIELD OF THE INVENTION

The present invention generally relates to a method of depositing a film on a substrate for a semiconductor device, and more particularly to a method of depositing a film by liquid phase atomic layer deposition (ALD).

BACKGROUND OF THE INVENTION

ALD is a well-known method of layer by layer film growth in which a substrate is alternately exposed to two or more gas phase reagents or precursors that are temporally or spatially separated from each other such that they cannot mix in the gas phase, but only react with each other on the surface of the substrate being coated by the film. Typically the precursors are separated by some type of purging or evacuation of a deposition chamber that is being held at reduced pressure. While ALD may be practiced in a regime where simple adsorption of a precursor is used to saturate the surface of a substrate, it is more typical that the precursors react with groups on the surface of the wafer to form a chemisorbed layer after each exposure. By-products of the chemisorption reactions are typically removed from the chamber during purging after each exposure step.

Further, ALD as practiced for industrial purposes is typically performed at moderate temperatures in the range of 100° C. to 400° C. Well known processes exist for deposition of metal oxide films such as $Al_2O_3$, $HfO_2$, $ZrO_2$, $La_2O_3$, $Y_2O_3$, etc., in addition to metal nitrides such as $Ti_3N_4$, $Hf_3N_4$, $Ta_3N_5$, etc. By introducing reducing reagents such as $H_2$ or $NH_3$ into the reaction sequence, usually in combination with a plasma as Plasma Enhanced ALD (PEALD), it is possible to deposit metallic/conducting films such as TiN, TaN, HfN, Ru, etc.

The major advantages of ALD and PEALD include the self-limited nature of the film growth which allows for excellent, in some cases near-perfect, film conformality over relatively high aspect ratio structures even at very small nanometer scale dimensions, and also allows for excellent thickness control and extremely low non-uniformity across large substrate areas. In addition, the temperature of ALD and PEALD depositions is typically lower than chemical vapor deposition (CVD) processes that deposit the same film with similar compositional purity, thus enabling a lower thermal budget for film deposition.

ALD has several limitations as well. For instance, it is typically slower than the corresponding CVD process because the deposition is done sequentially rather than in a continuous process. Thus, it is more economically feasible to use ALD to grow very thin films. In addition, ALD requires precursors that have a sufficient vapor pressure and thermal stability to be delivered in the gas phase. The substrate and deposition chamber need to be maintained at high enough temperature and low enough pressure to maintain the precursor and byproducts in the gas phase so that any excess precursor passes the substrate unreacted without building up residue from unwanted by-products.

SUMMARY OF THE INVENTION

Embodiments of the invention describe a method of depositing a film by liquid phase ALD.

According to one embodiment, the method includes providing a substrate in a process chamber, spinning on the substrate a first reactant in a first liquid to form a self-limiting layer of the first reactant on the substrate, spinning on the substrate a second reactant in a second liquid, where the second reactant reacts with the self-limiting layer of the first reactant on the substrate to form a film on the substrate, and repeating the spinning steps at least once.

According to another embodiment, the method includes providing the substrate in a process chamber, spinning on the substrate a first reactant in a first liquid to form a self-limiting layer of the first reactant on the substrate, rinsing the substrate to remove excess of the first reactant from the substrate, spinning on the substrate a second reactant in a second liquid, where the second reactant reacts with the self-limiting layer of the first reactant on the substrate to form a film on the substrate, rinsing the substrate to remove excess of the second reactant from the substrate, and repeating the spinning steps at least once.

DETAILED DESCRIPTION OF SEVERAL EMBODIMENTS

Embodiments of the invention provide a processing system and method for depositing a film on a substrate by liquid phase ALD. In some examples, the film may be a high-k film.

Figure 1:
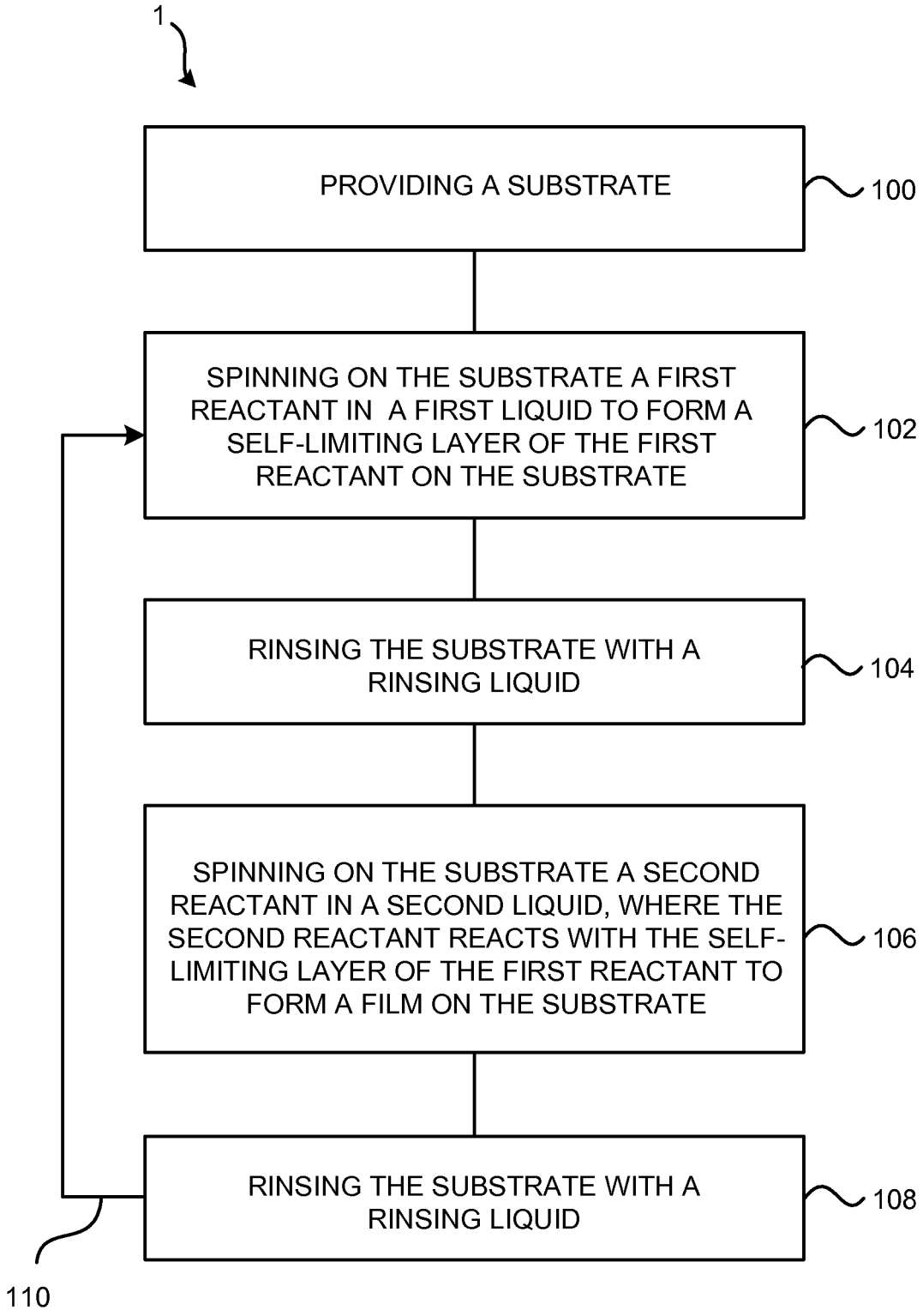
FIG. 1 is a process flow diagram for processing a substrate according to an embodiment of the invention.
Figure 3:
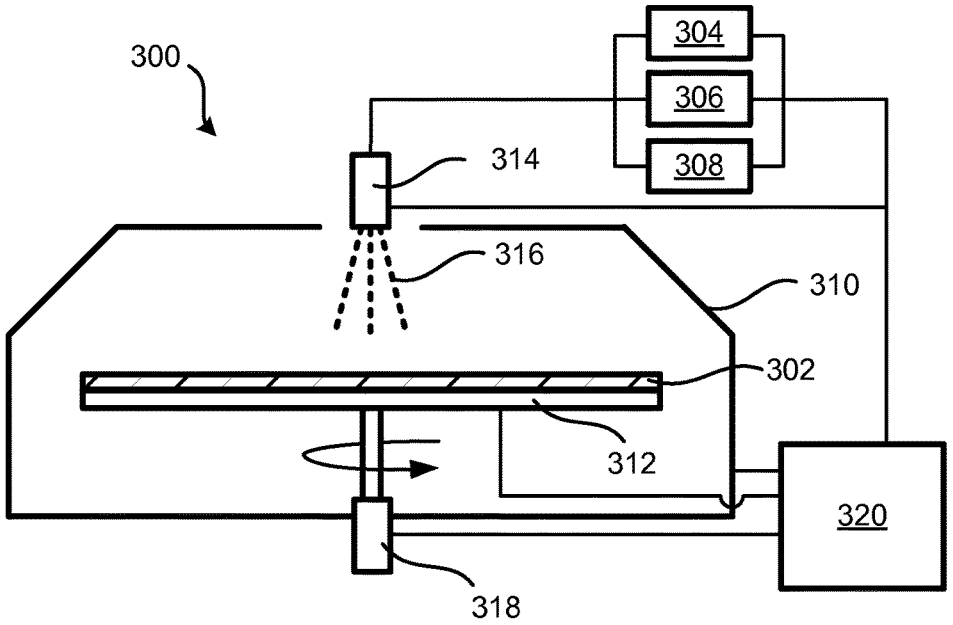
FIG. 3 schematically shows a processing system for processing a substrate according to an embodiment of the invention.

FIG. 1 is a process flow diagram 1 for processing a substrate according to an embodiment of the invention. In step 100, the method includes providing a substrate in a process chamber of a processing system. An exemplary processing system is schematically shown in FIG. 3. The processing system may be configured to process 200 mm substrates, 300 mm substrates, or larger-sized substrates. In fact, it is contemplated that the processing system may be configured to process substrates, wafers, or LCDs regardless of their size, as would be appreciated by those skilled in the art. Therefore, while aspects of embodiments of the invention will be described in connection with the processing of a semiconductor substrate, the invention is not limited solely thereto.

In step 102, the method includes spinning on the substrate a first reactant in a first liquid. The first reactant may be an organic compound that contains one or more a metal elements from the Periodic Table of the Elements. Non-limiting examples of the first reactant include trimethylaluminum (TMA), tris(bis(trimethylsilyl)amido)lanthanum, and tetrakis(dimethylamido)titanium (TDMAT). The first liquid can be an organic compound that readily dissolves the first reactant and facilitates transport of the first reactant to the substrate in the process chamber. Non-limiting examples of the first liquid include octane and pyridine. Step 102 may be performed using a liquid delivery nozzle positioned above an upper surface of the rotating substrate. Upon coming in contact with the substrate, a self-limited layer of the first reactant or reaction products of the first reactants is formed on the substrate, and excess first reactant in the first liquid is spun off the substrate.

In step 104, the method includes rinsing the substrate with a rinsing liquid. The substrate may be spinning during the rinsing and the rinsing can aid in removing excess first reactant and reaction by-products from the substrate. Non-limiting examples of the first liquid include octane and pyridine.

In step 106, the method includes spinning on the substrate a second reactant in a second liquid. The second reactant may be an oxidizing agent or a reducing agent. Non-limiting examples of the second reactant include water, ethylene glycol, ethane-1,2-dithiol, or ammonia. The second liquid may be the same as the first liquid. The second liquid can be an organic compound that readily dissolves the second reactant and facilitates transport of the second reactant to the substrate in the process chamber. Non-limiting examples of the second liquid include octane and pyridine. Step 106 may be performed using a liquid delivery nozzle positioned above an upper surface of the rotating substrate. Upon coming in contact with the substrate, the second reactant reacts with the self-limited layer of the first reactant or reaction products of the first reactants, and excess second reactant in the second liquid is spun off the substrate. Step 106 forms a film or a portion of a film that provides a suitable surface for repeating steps 102 and 106 at least once until the film has a desired thickness. This is shown by process arrow 110.

In step 108, the method includes rinsing the substrate with a rinsing liquid. The substrate may be spinning during the rinsing and the rinsing can aid in removing second reactant and reaction by-products from the substrate. Non-limiting examples of the rinsing liquid include octane and pyridine.

According to some embodiments of the invention, the substrate may be heat-treated after one or more of the spinning steps 102 and 106 and/or after one or more of the rinsing steps 104 and 108. The heat-treating may be performed by increasing the substrate temperature above the temperature of steps 102-108. According to one embodiment, the substrate may be heat-treated after several cycles of steps 102-104 and/or when the film has been deposited on the substrate with the desired thickness. The heat-treating may be carried out at a substrate temperature that is sufficiently high for curing the film.

According to some embodiments of the invention, the substrate may be exposed to a reducing atmosphere after one or more of the spinning steps 102 and 106 and/or after one or more of the rinsing steps 104 and 108. The reducing atmosphere can contain hydrogen, ammonia, or a combination thereof. The exposure to the reducing atmosphere may be combined with the heat-treating described above. According to one embodiment, the substrate may be exposed to the reducing atmosphere after several cycles of steps 102-104 and/or when the film has been deposited on the substrate with the desired thickness.

Figure 2:
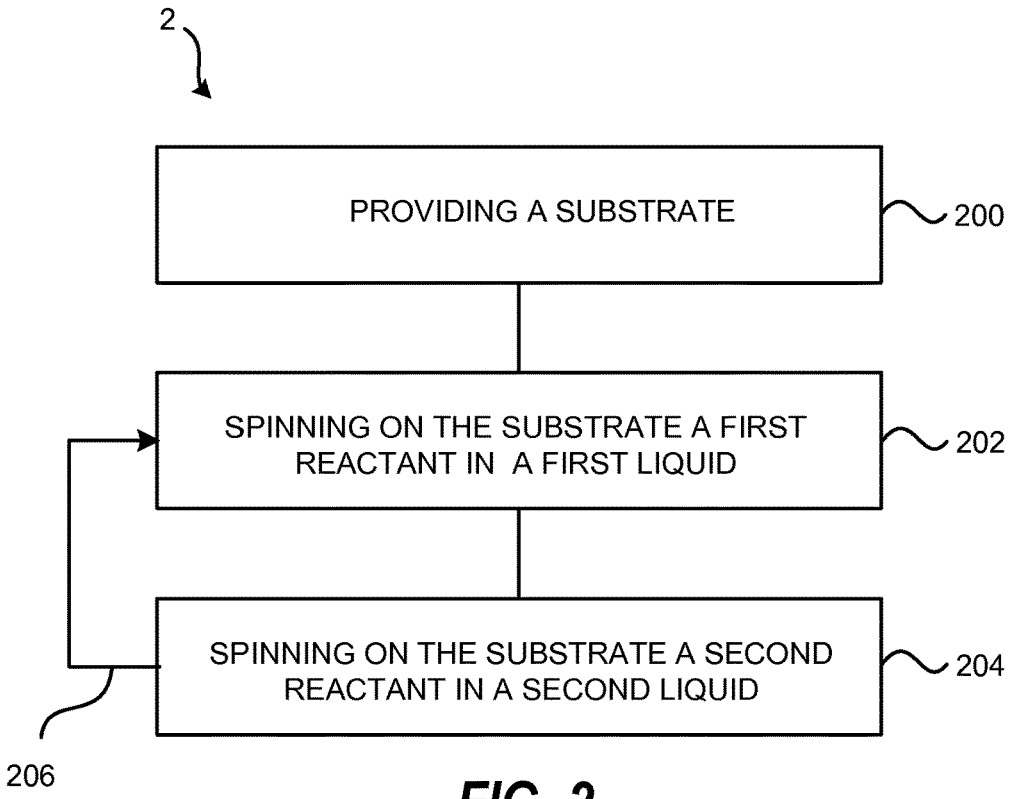
FIG. 2 is a process flow diagram for processing a substrate according to an embodiment of the invention.

FIG. 2 is a process flow diagram 2 for processing a substrate according to an embodiment of the invention. The process flow diagram 2 is similar to the process flow diagram 1 of FIG. 1 but the steps 104 and 108 of rinsing the substrate with a rinsing liquid are omitted. The process flow diagram 2 includes, in step 200, providing the substrate in a process chamber, in step 202, spinning on the substrate a first reactant in a first liquid to form a self-limiting layer of the first reactant on the substrate, in step 204, spinning on the substrate a second reactant in a second liquid, where the second reactant reacts with the self-limiting layer of the first reactant on the substrate to form a film on the substrate, and in step 206, repeating the spinning steps at least once until the film has a desired thickness.

Example 1: Deposition of an $Al_2O_3$ Film

The method includes, spinning on a substrate a solution of trimethylaluminum (TMA) reactant in octane liquid, rinsing the substrate with octane rinsing liquid, spinning on the substrate a solution of water reactant in pyridine liquid, and rinsing the substrate with octane rinsing solution. These steps may be performed a plurality of times (e.g., 10 times) under an inert atmosphere (e.g., Ar or $N_2$). Thereafter, the $Al_2O_3$ film may be heat-treated in vacuum at 300° C. for 1 minute.

Example 2: Metalorganic Film—Alucone (Aluminum Alkoxide Polymer)

The method includes, spinning on a substrate a solution of trimethylaluminum (TMA) reactant in octane liquid, rinsing the substrate with octane rinsing liquid, spinning on the substrate a solution of ethylene glycol reactant in octane liquid, and rinsing the substrate with octane rinsing solution. These steps may be performed a plurality of times (e.g., 10 times) under an inert atmosphere (e.g., Ar or $N_2$). Thereafter, the alucone film may be heat-treated in vacuum.

Example 3: Metalorganic Film—Thio-Alucone (Alucone-Like Film with Sulfur in the Place of Oxygen)

The method includes, spinning on a substrate a solution of trimethylaluminum (TMA) reactant in octane liquid, rinsing the substrate with octane rinsing liquid, spinning on the substrate a solution of ethane-1,2-dithiol reactant in octane liquid, and rinsing the substrate with octane rinsing solution. These steps may be performed a plurality of times (e.g., 10 times) under an inert atmosphere (e.g., Ar or $N_2$). Thereafter, the thio-alucone film may be heat-treated in vacuum.

Example 4: $La_2O_3$ Film

The method includes, spinning on a substrate a solution of tris(bis(trimethylsilyl)amido)lanthanum reactant in octane liquid, rinsing the substrate with octane rinsing liquid, spinning on the substrate a solution of water reactant in pyridine liquid, and rinsing the substrate with octane rinsing solution. These steps may be performed a plurality of times (e.g., 10 times) under an inert atmosphere (e.g., Ar or $N_2$). Thereafter, the $La_2O_3$ film may be heat-treated in vacuum at 300° C. for 1 minute, and the deposition process repeated until the $La_2O_3$ film has a desired thickness.

Example 5: Reduced Metal Nitride Film

The method includes, spinning on a substrate a solution of tetrakis(dimethylamido)titanium (TDMAT) reactant in octane liquid, rinsing the substrate with octane rinsing liquid, spinning on the substrate a solution of ammonia reactant in pyridine liquid, and rinsing the substrate with octane rinsing solution. These steps may be performed a plurality of times (e.g., 5 times) under an inert atmosphere (e.g., Ar or $N_2$). Thereafter, the film may be exposed to plasma-excited $H_2$ gas and while heat-treated at 200° C. The deposition process may be repeated until the TiN film has a desired thickness.

FIG. 3 schematically shows a processing system 300 for processing a substrate according to an embodiment of the invention. The processing system 300 may be a semi-closed spin-on deposition system similar to what the semiconductor industry currently employs for coating substrates (wafers) with photoresist layers. The semi-closed configuration allows fume control and minimizes exhaust volume. The processing system 300 contains a process chamber 310 that includes a substrate holder 312 for supporting, heating, and rotating (spinning) a substrate 302, a rotating means 318 (e.g., a motor), and a liquid delivery nozzle 314 configured for providing a processing liquid 316 to an upper surface of the substrate 302. Liquid supply systems 304, 306 and 308 supply different processing liquids to the liquid delivery nozzle 314. The different processing liquids can, for example, include a first reactant in a first liquid, a second reactant in a second liquid, and a rinsing liquid. According to other embodiments, the processing system 300 may include additional liquid delivery nozzles (not shown) for providing different liquids to the substrate. Exemplary rotating speeds can be between about 500 rpm and about 1500 rpm, for example 1000 rpm, during exposure of the upper surface of the substrate 302 to the processing liquid 316.

The processing system 300 further includes a controller 320 that can be coupled to and control the process chamber 310, the liquid supply systems 304, 306 and 308, the liquid delivery nozzle 314, the rotating means 318, means for heating the substrate holder 312. The substrate 302 may be under an inert atmosphere during the film deposition. The processing system 300 may be configured to process 200 mm substrates, 300 mm substrates, or larger-sized substrates. The processing system 300 may be configured to process substrates, wafers, or LCDs regardless of their size, as would be appreciated by those skilled in the art. Therefore, while aspects of the invention will be described in connection with the processing of a semiconductor substrate, the invention is not limited solely thereto.

A processing system and method for depositing a film on a substrate by liquid phase ALD have been disclosed in various embodiments. The foregoing description of the embodiments of the invention has been presented for the purposes of illustration and description. It is not intended to be exhaustive or to limit the invention to the precise forms disclosed. This description and the claims following include terms that are used for descriptive purposes only and are not to be construed as limiting. Persons skilled in the relevant art can appreciate that many modifications and variations are possible in light of the above teaching. Persons skilled in the art will recognize various equivalent combinations and substitutions for various components shown in the Figures. It is therefore intended that the scope of the invention be limited not by this detailed description, but rather by the claims appended hereto.

What is claimed is:

1. A method for processing a substrate, the method comprising:

providing the substrate in a process chamber;

spinning onto the substrate a first reactant in a first liquid to deposit a self-limiting layer of the first reactant on the substrate, wherein the first reactant includes trimethylaluminum, tris(bis(trimethylsilyl)amido)lanthanum, or tetrakis(dimethylamido)titanium;

thereafter, spinning onto the substrate a second reactant in a second liquid, wherein the second reactant reacts with the deposited self-limiting layer of the first reactant on the substrate to form a deposited film on the substrate; and sequentially repeating the spinning steps at least once until the deposited film has a desired thickness.

2. The method of claim 1, further comprising heat-treating the substrate after one or more of the spinning steps.

3. The method of claim 1, further comprising heat-treating the substrate after the film has been deposited on the substrate with the desired thickness.

4. The method of claim 1, further comprising rinsing the substrate with a rinsing liquid after one or more of the spinning steps.

5. The method of claim 4, wherein the rinsing liquid contains octane or pyridine.

6. The method of claim 4, further comprising heat-treating the substrate after the rinsing step.

7. The method of claim 1, further comprising exposing the substrate to a reducing atmosphere after one or more of the spinning steps.

8. The method of claim 7, wherein the reducing atmosphere includes hydrogen, ammonia, or a combination thereof.

9. The method of claim 7, wherein the exposing the substrate to a reducing atmosphere further comprises heat-treating the substrate.

10. The method of claim 1, wherein the second reactant includes water, ethylene glycol, ethane-1,2-dithiol, or ammonia.

11. The method of claim 1, wherein the first liquid, the second liquid, or both the first and second liquids, contain octane or pyridine.

12. The method of claim 1, wherein the deposited self-limiting layer consists of the first reactant, a flow of the first liquid into the process chamber for spinning the first reactant onto the substrate is stopped before spinning the second reactant onto the substrate, and a flow of the second liquid into the process chamber for spinning the second reactant onto the substrate is stopped before sequentially repeating the spinning steps.

13. A method for processing a substrate, the method comprising:

providing the substrate in a process chamber;

spinning on the substrate a first reactant in a first liquid to form a self-limiting layer of the first reactant on the substrate;

thereafter, spinning on the substrate a second reactant in a second liquid, wherein the second reactant reacts with the self-limiting layer of the first reactant on the substrate to form a film on the substrate; and sequentially repeating the spinning steps at least once until the film has a desired thickness, wherein the film contains $Al_2O_3$, Alucone, Thio-Alucone, $La_2O_3$, or TiN.

14. The method of claim 13, wherein the first reactant includes trimethylaluminum, tris(bis(trimethylsilyl)amido) lanthanum, or tetrakis(dimethylamido)titanium.

15. The method of claim 13, further comprising heat-treating the substrate after one or more of the spinning steps, or heat-treating the substrate after the film has been deposited on the substrate with the desired thickness.

16. A method for processing a substrate, the method comprising:

providing the substrate in a process chamber;

spinning on the substrate a first reactant in a first liquid to form a self-limiting layer of the first reactant on the substrate, the first reactant containing a metal element;

rinsing the substrate to remove excess of the first reactant from the substrate;

thereafter, spinning on the substrate a second reactant in a second liquid, wherein the second reactant reacts with the self-limiting layer of the first reactant on the substrate to form a film on the substrate;

rinsing the substrate to remove excess of the second reactant from the substrate; and sequentially repeating the spinning and rinsing steps at least once until the film has a desired thickness, wherein the film contains $Al_2O_3$, Alucone, Thio-Alucone, $La_2O_3$, or TiN.

17. The method of claim 16, further comprising heat-treating the substrate after one or more of the spinning steps.

18. The method of claim 16, further comprising heat-treating the substrate after the film has been deposited on the substrate with the desired thickness.

19. The method of claim 16, wherein the first reactant includes trimethylaluminum, tris(bis(trimethylsilyl)amido) lanthanum, or tetrakis(dimethylamido)titanium, and wherein the second reactant includes water, ethylene glycol, ethane-1,2-dithiol, or ammonia.

20. A method for processing a substrate, the method comprising:

providing the substrate in a process chamber;

spinning on the substrate a first reactant in a first liquid to form a self-limiting layer of the first reactant on the substrate;

spinning on the substrate a second reactant in a second liquid, wherein the second reactant reacts with the self-limiting layer of the first reactant on the substrate to form a film on the substrate;

repeating the spinning steps at least once until the film has a desired thickness; and optionally, rinsing the substrate with a rinsing liquid after one or more of the spinning steps, wherein one or any combination of the first liquid, the second liquid, or the rinsing liquid contain octane or pyridine, and wherein the film contains $Al_2O_3$, Alucone, Thio-Alucone, $La_2O_3$, or TiN, or wherein the first reactant includes trimethylaluminum, tris(bis(trimethylsilyl)amido)lanthanum, or tetrakis(dimethylamido)titanium.

* * * * *